US012669260B1

(12) United States Patent
Huang

(10) Patent No.: US 12,669,260 B1
(45) Date of Patent: Jun. 30, 2026

(54) VENTILATION OPENING EXTENDER

(71) Applicant: Zhiyuan Huang, Dongguan City (CN)

(72) Inventor: Zhiyuan Huang, Dongguan City (CN)

( * ) Notice: Subject to any disclaimer, the term of this patent is extended or adjusted under 35 U.S.C. 154(b) by 0 days.

(21) Appl. No.: 19/390,657

(22) Filed: Nov. 16, 2025

(51) Int. Cl.
*F24F 13/08* (2006.01)

(52) U.S. Cl.
CPC ..... *F24F 13/084* (2013.01)

(58) Field of Classification Search
CPC ..... F24F 13/06; F24F 13/08; F24F 13/082; F24F 13/084
See application file for complete search history.

(56) References Cited

U.S. PATENT DOCUMENTS 3,225,679 A * 12/1965 Meyer ..... F24F 13/08 454/307
11,506,418 B1 * 11/2022 Mosiman ..... F24F 13/084

OTHER PUBLICATIONS

Beswel, Sideways Air Vent Extender for Under Furniture, Nov. 27, 2023, Amazon.com (Year: 2023).*

* cited by examiner

*Primary Examiner* — Allen R. B. Schult

(57) ABSTRACT

A ventilation opening extender includes a first extension structure, a second extension structure and a magnetic structure. The first extension structure is arranged at a ventilation opening. The second extension structure covers the first extension structure and is movable on the first extension structure. The magnetic structure is configured for attracting the first extension structure at the ventilation opening. The first extension structure is arranged on the vent to change an airflow direction of the ventilation opening. The second extension structure covers the first extension structure and is telescopically movable on the first extension structure to extend the airflow direction.

15 Claims, 10 Drawing Sheets

VENTILATION OPENING EXTENDER

TECHNICAL FIELD

The present disclosure relates to the field of ventilation opening extension, particularly to a ventilation opening extender.

BACKGROUND ART

The existing ventilation openings are fixed in position and airflow direction. That is inconvenient in use. The ventilation opening is unmovable, and the airflow direction cannot be changed according to diverse user needs.

SUMMARY

In order to overcome the shortcomings of the prior art, the present disclosure provides a ventilation opening extender including a first extension structure, a second extension structure, and a magnetic structure.

The first extension structure is arranged at a ventilation opening.

The second extension structure covers the first extension structure and is movable on the first extension structure.

The magnetic structure is configured for attracting the first extension structure at the ventilation opening.

As an improvement of the present disclosure, the first extension structure includes a first side wall and a second side wall. The first side wall is arranged opposite to the second side wall. A first top plate is provided between the first side wall and the second side wall. A first end of the first top plate is connected to the first side wall. A second end of the first top plate is connected to the second side wall.

As an improvement of the present disclosure, a plurality of first protrusions extend out from an upper surface of the first top plate. The plurality of first protrusions are sequentially arranged on the upper surface of the first top plate. The plurality of first protrusions extend in a width direction of the upper surface of the first top plate.

As an improvement of the present disclosure, a plurality of first recesses extend from a lower surface of the first top plate. The plurality of first recesses are sequentially arranged on the lower surface of the first top plate. The plurality of first recesses and first protrusions are in a one-to-one correspondence.

As an improvement of the present disclosure, a second protrusion extends out from an upper surface of each of the first protrusions. A second recess extends from a lower surface of each of the first protrusions. The second protrusion corresponds to the second recess in position.

As an improvement of the present disclosure, the first side wall includes a first side surface and a second side surface. The first side surface and the second side surface are arranged at an included angle. The first side surface is connected to the first top plate. A first end of the second side surface is connected to the first side surface. A second end of the second side surface is provided with a first rim along a length direction of the first extension structure.

As an improvement of the present disclosure, the second side wall includes a third side surface and a fourth side surface. The third side surface and the fourth side surface are arranged at an included angle. The third side surface is connected to the first top plate. A first end of the fourth side surface is connected to the third side surface. A second end of the fourth side surface is provided with a second rim along the length direction of the first extension structure.

As an improvement of the present disclosure, the first extension structure further includes a third side wall and a first opening provided opposite to the third side wall. The third side wall is arc-shaped. The third side wall is provided with a first end and a second end. The first end of the third side wall is connected to the first side wall. The second end of the third side wall is connected to the second side wall.

As an improvement of the present disclosure, the third side wall is further provided with a third end and a fourth end. The third end of the third side wall is connected to the first top plate. The fourth end of the third side wall is provided with a third rim. Two ends of the third rim are respectively connected to the first rim and the second rim. The third rim, the first rim and the second rim are coplanar.

As an improvement of the present disclosure, the second extension structure includes a fourth side wall and a fifth side wall. The fourth side wall is arranged opposite to the fifth side wall. A second top plate is provided between the fourth side wall and the fifth side wall. A first end of the second top plate is connected to the fourth side wall. A second end of the second top plate is connected to the fifth side wall.

As an improvement of the present disclosure, a plurality of third protrusions extend out from an upper surface of the second top plate. The plurality of third protrusions are sequentially arranged on the upper surface of the second top plate. The plurality of third protrusions extend in a width direction of the upper surface of the second top plate.

As an improvement of the present disclosure, a plurality of third recesses extend from a lower surface of the second top plate. The plurality of third recesses are sequentially arranged on the lower surface of the second top plate. The plurality of third recesses and third protrusions are in a one-to-one correspondence.

As an improvement of the present disclosure, a fourth protrusion extends out from an upper surface of each of the third protrusions, a fourth recess extends from a lower surface of each of the third protrusions. The fourth protrusion corresponds to the fourth recess in position.

As an improvement of the present disclosure, the fourth side wall includes a fifth side surface and a sixth side surface. The fifth side surface and the sixth side surface are arranged at an included angle. The fifth side surface is connected to the second top plate. A first end of the sixth side surface is connected to the fifth side surface. A second end of the sixth side surface is provided with a fourth rim.

As an improvement of the present disclosure, the fifth side wall includes a seventh side surface and an eighth side surface. The seventh side surface and the eighth side surface are arranged at an included angle. The seventh side surface is connected to the second top plate. A first end of the eighth side surface is connected to the seventh side surface. A second end of the eighth side surface is provided with a fifth rim along a length direction of the second extension structure.

As an improvement of the present disclosure, the magnetic structure includes a plurality of magnetic members. The plurality of magnetic members are all arranged on the third rim. The plurality of magnetic members are sequentially arranged on the third rim along a width direction of the third rim.

As an improvement of the present disclosure, the plurality of magnetic members include a first magnetic member. The first magnetic member includes a first end portion and a second end portion. The first end portion is connected to the second end portion via a first connecting rod. The third rim defines a first through hole. The first end portion and the second end portion are respectively arranged on two sides of the first through hole. The first connecting rod is arranged in the first through hole and is respectively connected to the first end portion and the second end portion. A radius of the first end portion and a radius of the second end portion are greater than a radius of the first connecting rod and a radius of the first through hole. A first annular protrusion is arranged on the third rim around the first through hole. A first step surface is provided between the first annular protrusion and the first through hole. The first end portion is arranged on the first step surface.

As an improvement of the present disclosure, the plurality of magnetic members include a second magnetic member. The second magnetic member includes a third end portion and a fourth end portion. The third end portion is connected to the fourth end portion through a second connecting rod. The third rim defines a second through hole. The third end portion and the fourth end portion are respectively arranged on two sides of the second through hole. The second connecting rod is arranged in the second through hole and is respectively connected to the third end portion and the fourth end portion. A radius of the third end portion and a radius of the fourth end portion are greater than a radius of the second connecting rod and a radius of the second through hole. A second annular protrusion is arranged on the third rim around the second through hole. A second step surface is provided between the second annular protrusion and the second through hole. The fourth end portion is arranged on the second step surface.

As an improvement of the present disclosure, the plurality of magnetic members includes a third magnetic member. The third magnetic member includes a fifth end portion and a sixth end portion. The fifth end portion is connected to the sixth end portion via a third connecting rod. The third rim defines a third through hole. The fifth end portion and the sixth end portion are respectively arranged on two sides of the third through hole. The third connecting rod is arranged in the third through hole and is respectively connected to the fifth end portion and the sixth end portion. A radius of the fifth end portion and a radius of the sixth end portion are greater than a radius of the third connecting rod and a radius of the third through hole. A third annular protrusion is arranged on the third rim around the third through hole. A third step surface is provided between the third annular protrusion and the third through hole. The fifth end portion is arranged on the third step surface.

As an improvement of the present disclosure, the second extension structure is arranged on the first extension structure. The first protrusion is interlocked with the third protrusion. The second protrusion is interlocked with the fourth protrusion.

The present disclosure provides the ventilation opening extender, including the first extension structure, the second extension structure and the magnetic structure. The first extension structure is arranged at the ventilation opening. The second extension structure covers the first extension structure and is movable on the first extension structure. The magnetic structure attracts the first extension structure at the ventilation opening. Through the above structure, the first extension structure is arranged on the ventilation opening to change an airflow direction of the ventilation opening. The second extension structure covers the first extension structure and is telescopically movable on the first extension structure to extend the airflow direction. In this way, the airflow direction of the ventilation opening can be conveniently changed according to actual needs of the user.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
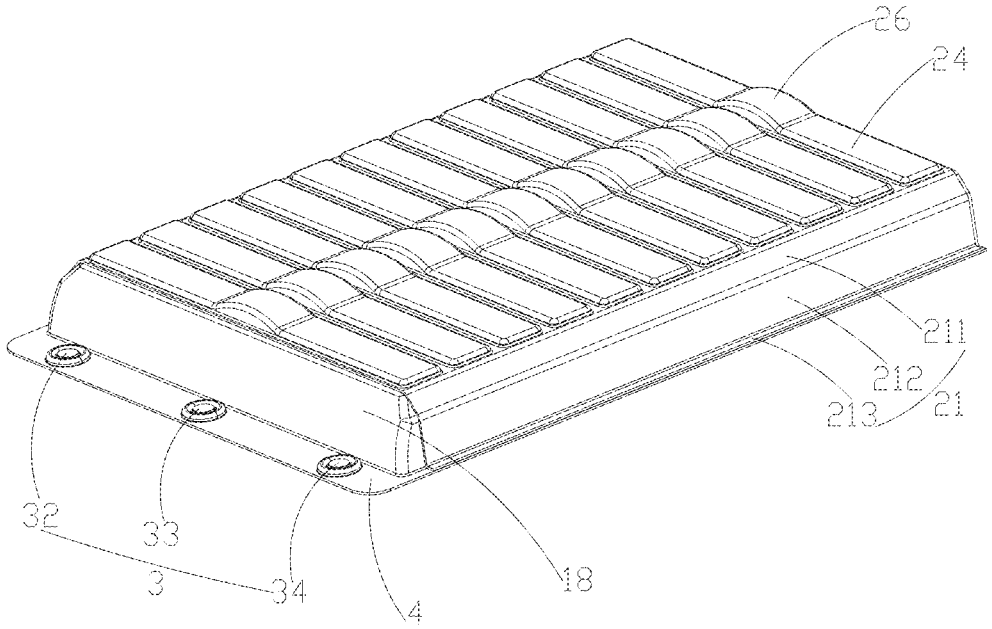
FIG. 1 is a structural schematic diagram of a second extension structure covering a first extension structure according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
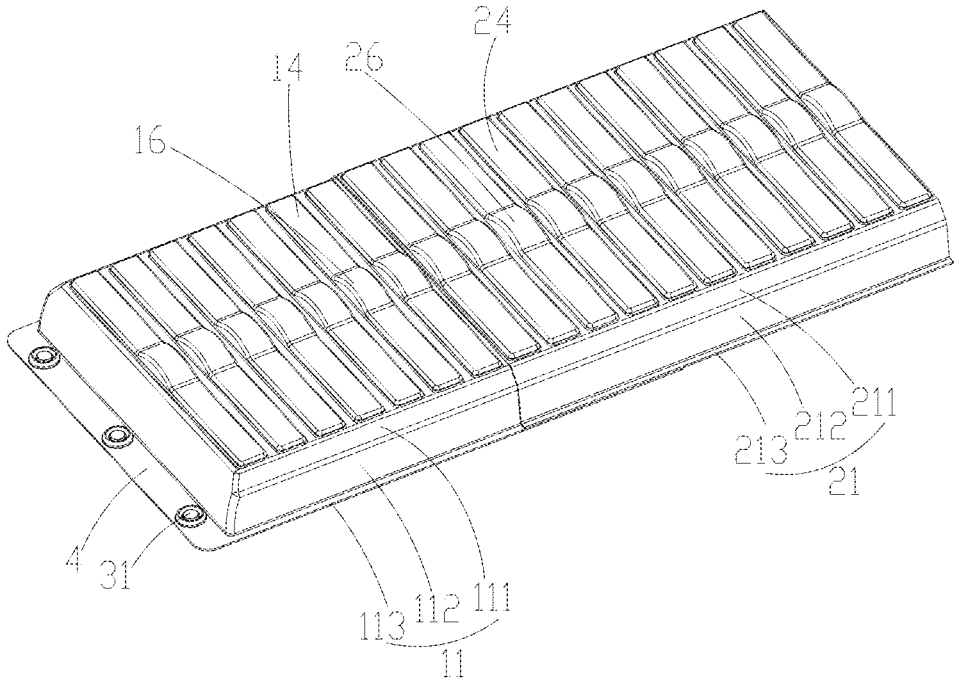
FIG. 2 is a structural schematic diagram of the second extension structure extending on the first extension structure of the present disclosure.
Figure 3:
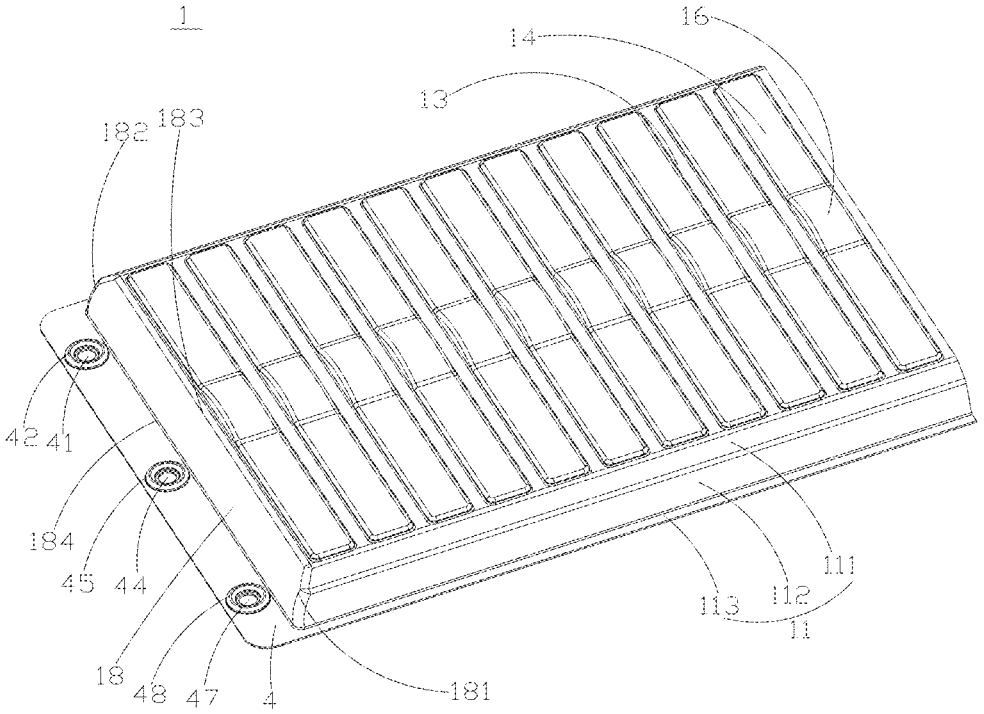
FIG. 3 is a structural schematic diagram of the first extension structure of the present disclosure.
Figure 4:
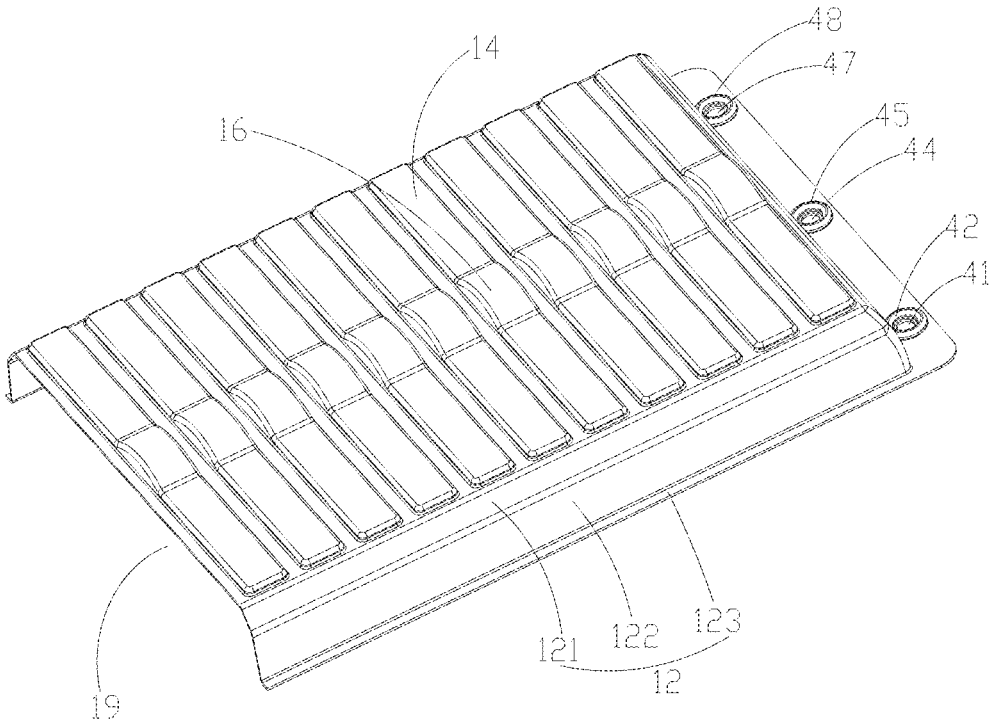
FIG. 4 is a structural schematic diagram of the first extension structure from another angle of the present disclosure.
Figure 5:
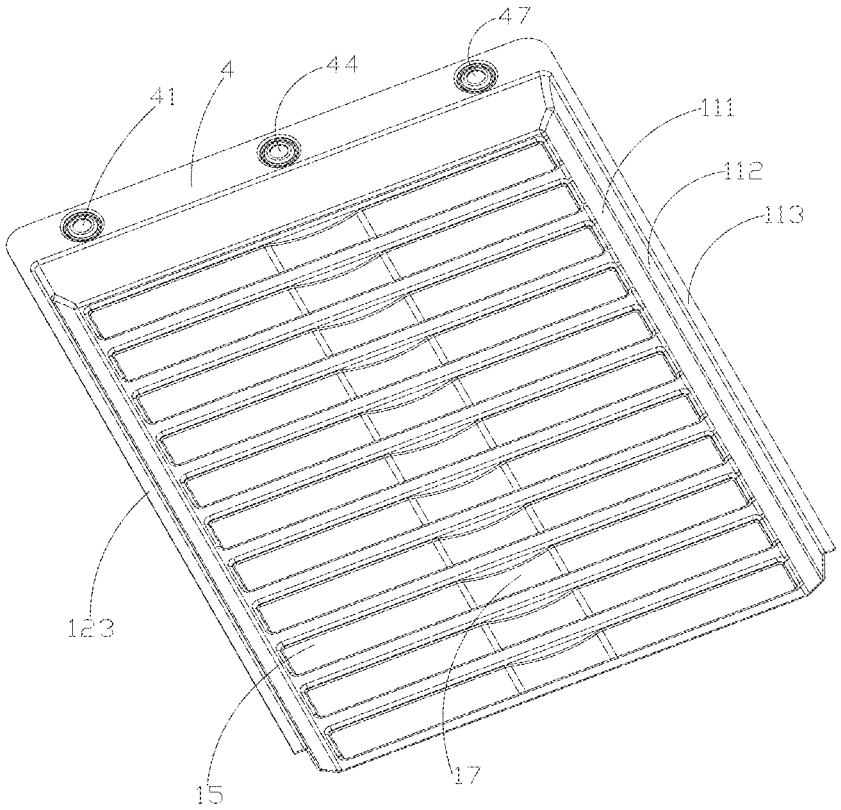
FIG. 5 is a schematic diagram of an internal structure of the first extension structure of the present disclosure.
Figure 6:
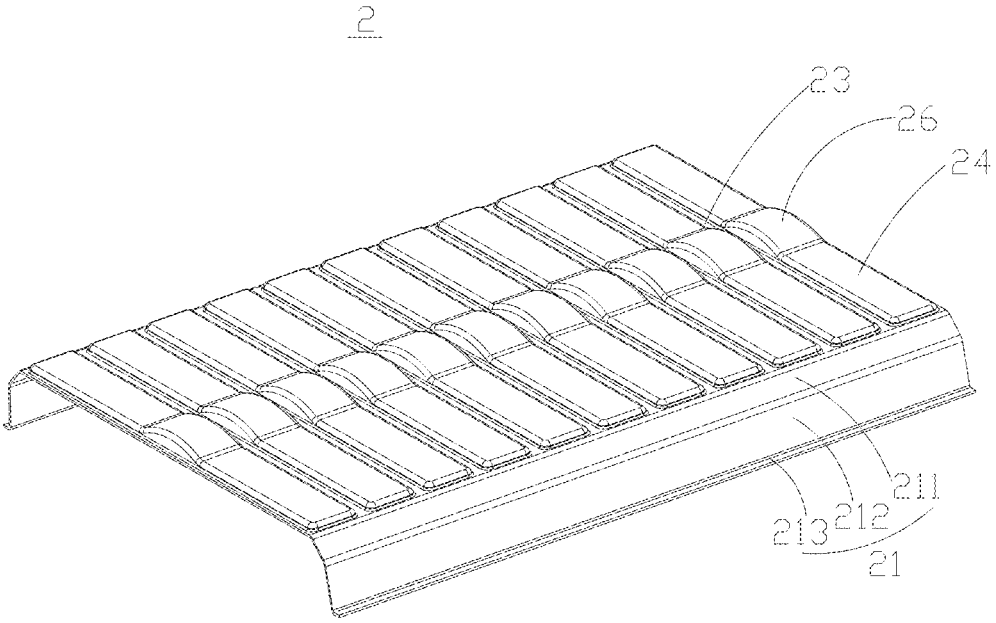
FIG. 6 is a structural schematic diagram of the second extension structure of the present disclosure.
Figure 7:
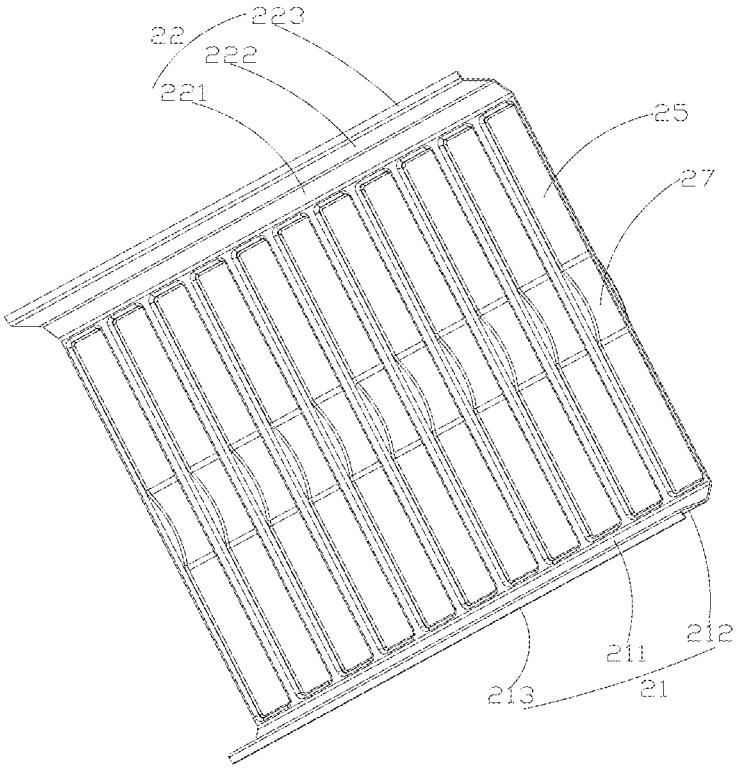
FIG. 7 is a structural schematic diagram of the second extension structure from another angle of the present disclosure.
Figure 8:
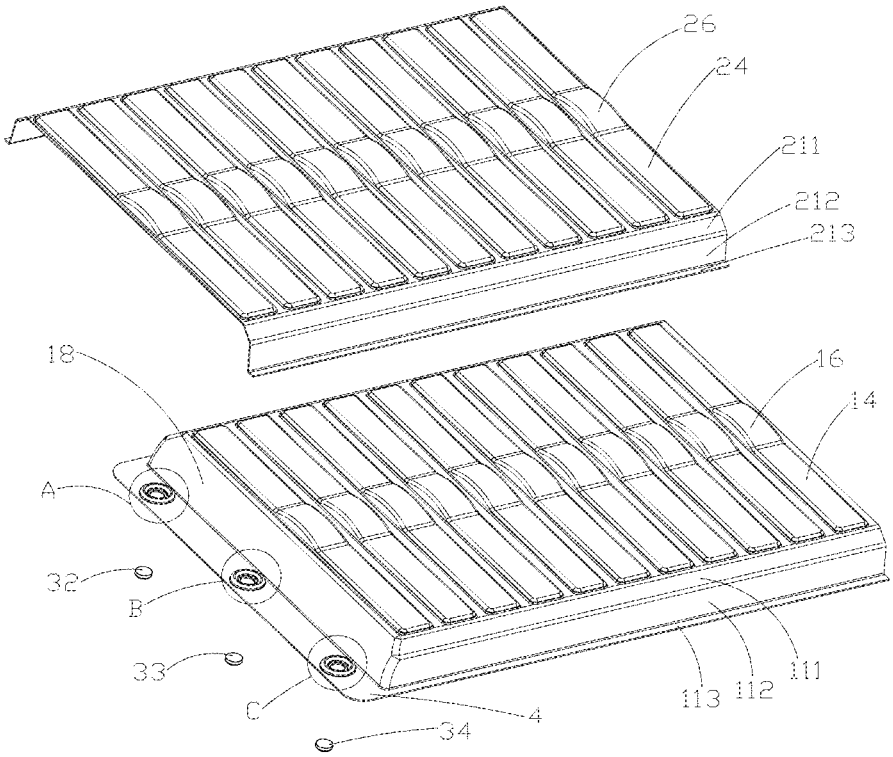
FIG. 8 is an exploded view of the present disclosure.
Figure 9:
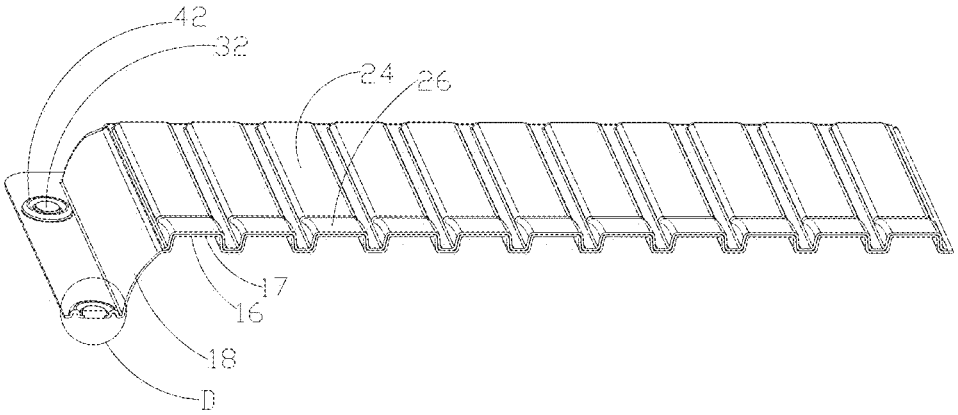
FIG. 9 is a cross-sectional view of the present disclosure.
Figure 10:
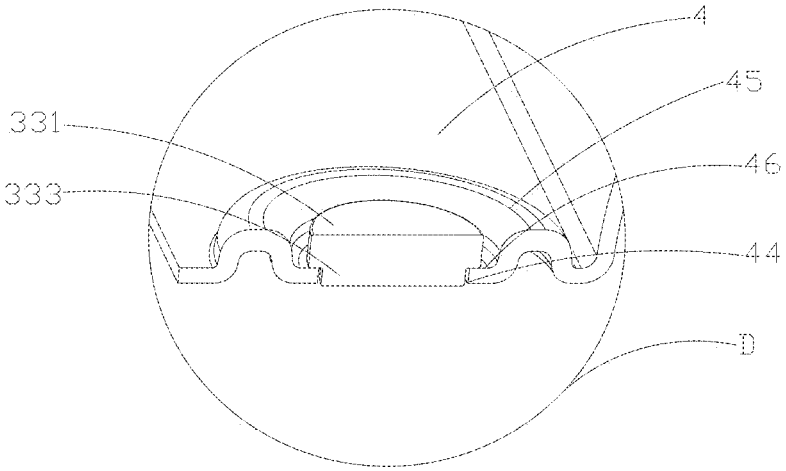
FIG. 10 is a structural schematic diagram at D in FIG. 9 of the present disclosure.
Figure 11:
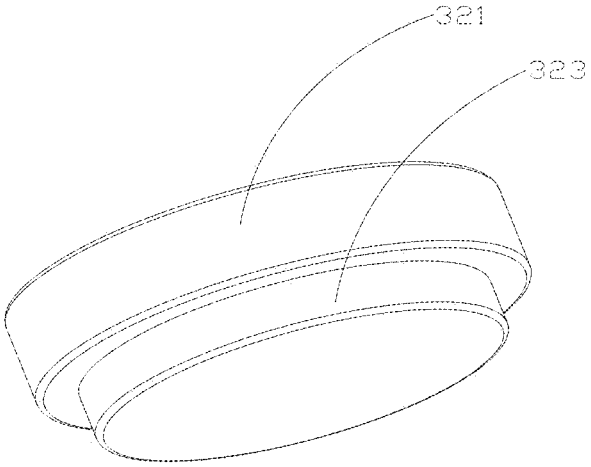
FIG. 11 is a structural schematic diagram of a first magnetic member in Embodiment 2 of the present disclosure.
Figure 12:
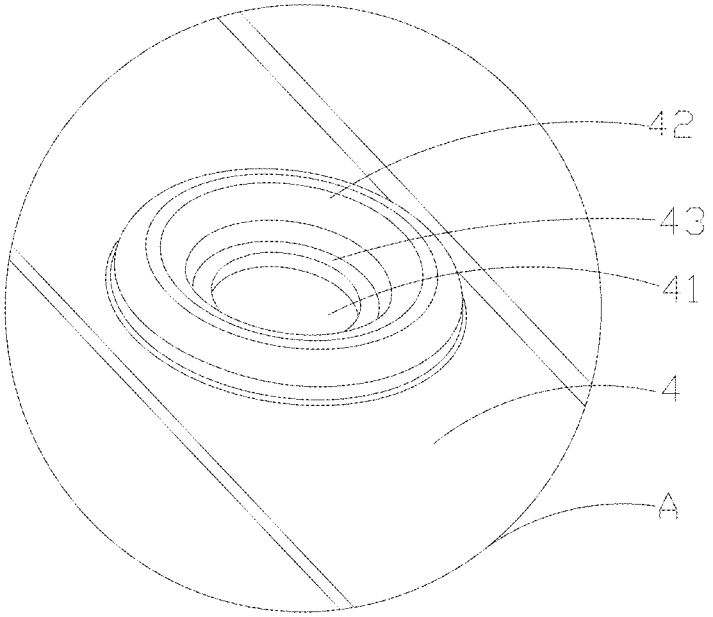
FIG. 12 is a structural schematic diagram at A in FIG. 8 of the present disclosure.
Figure 13:
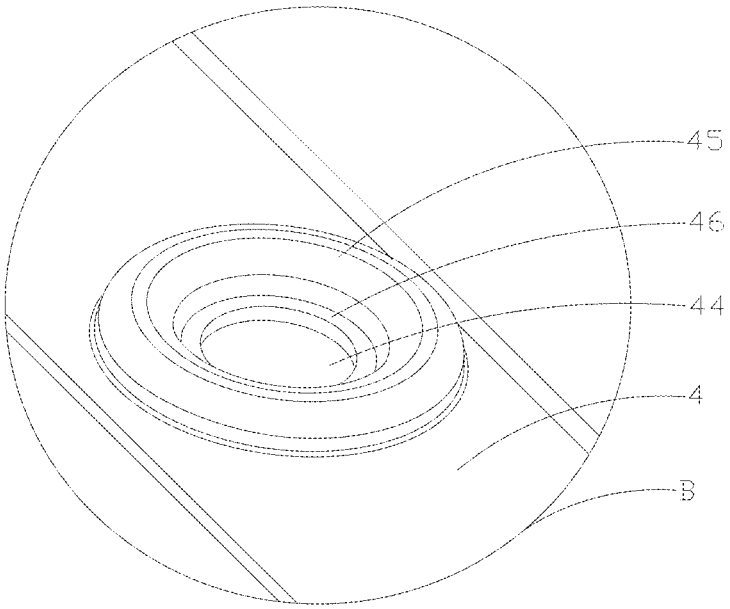
FIG. 13 is a structural schematic diagram at B in FIG. 8 of the present disclosure.
Figure 14:
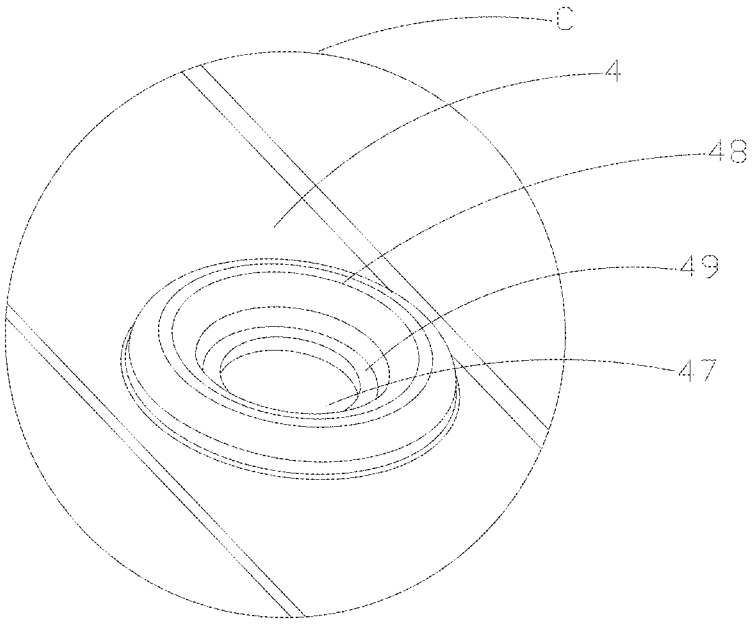
FIG. 14 is a structural schematic diagram at C in FIG. 8 of the present disclosure.
Figure 15:
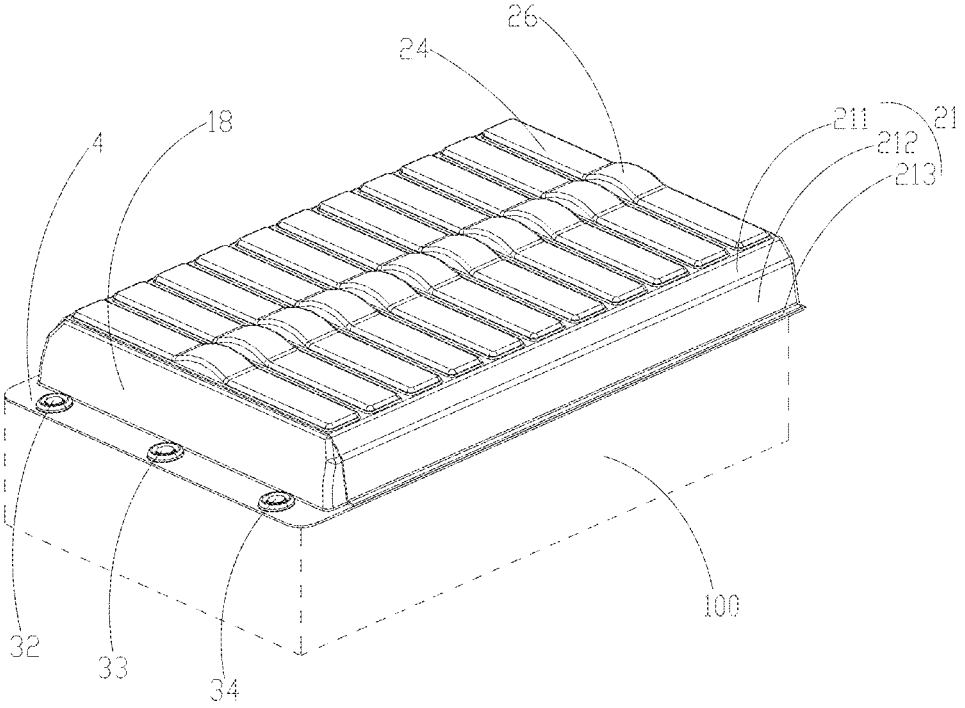
FIG. 15 is a structural schematic diagram of a ventilation opening extender arranged on a ventilation opening of the present disclosure.
Figure 16:
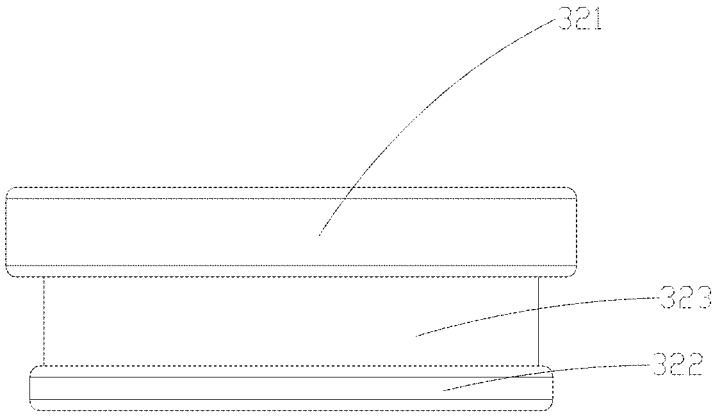
FIG. 16 is a structural schematic diagram of a first magnetic member in Embodiment 1 of the present disclosure.
Figure 17:
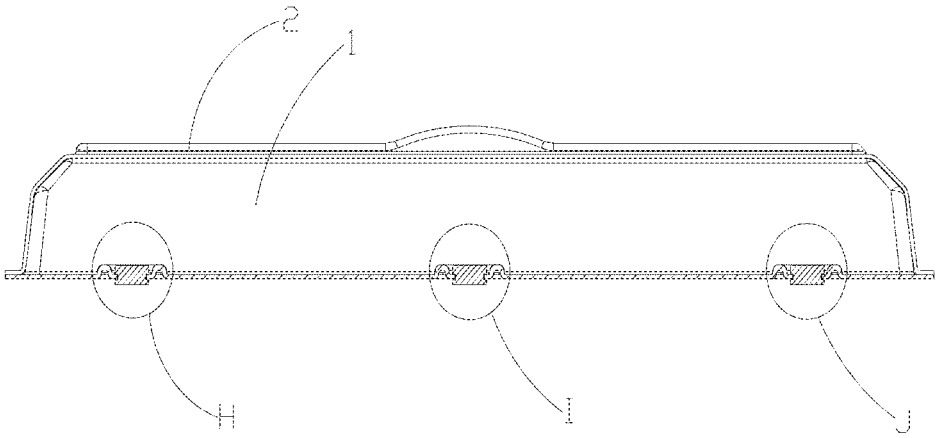
FIG. 17 is a cross-sectional view of the Embodiment 1 taken along an X axis of the present disclosure.
Figure 18:
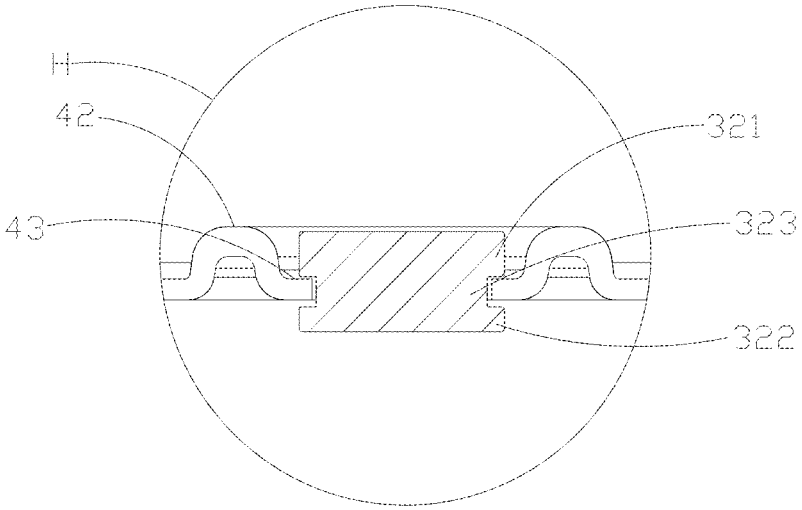
FIG. 18 is a structural schematic diagram at Hin FIG. 17 of the present disclosure.
Figure 19:
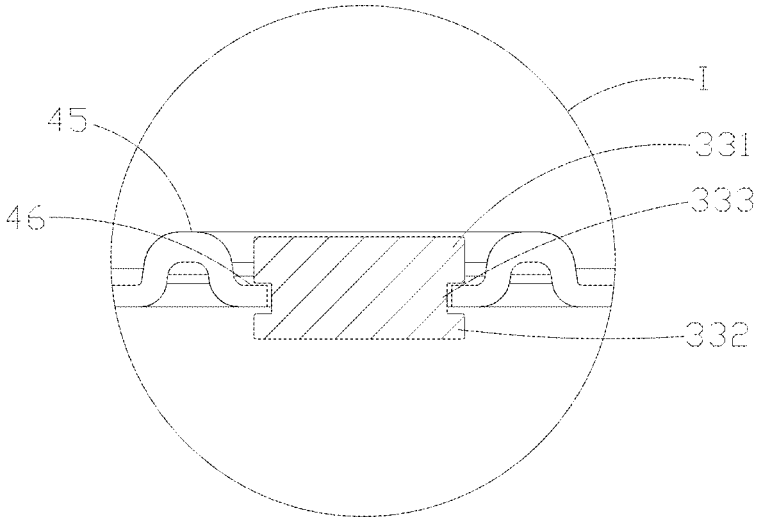
FIG. 19 is a structural schematic diagram at I in FIG. 17 of the present disclosure.
Figure 20:
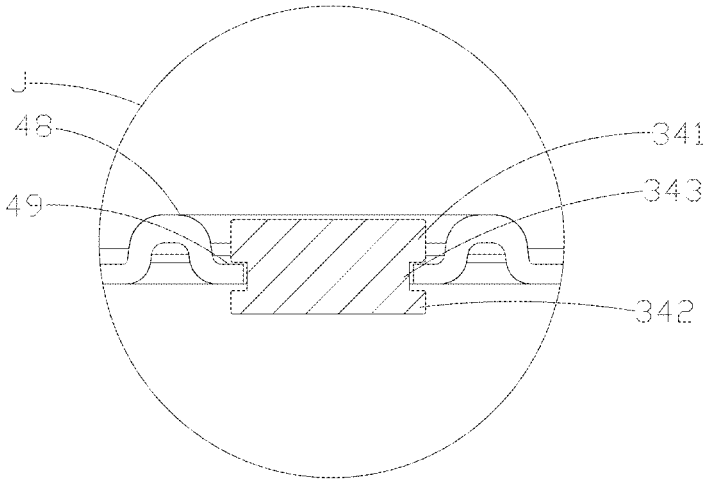
FIG. 20 is a structural schematic diagram at J in FIG. 17 of the present disclosure.
Figure 21:
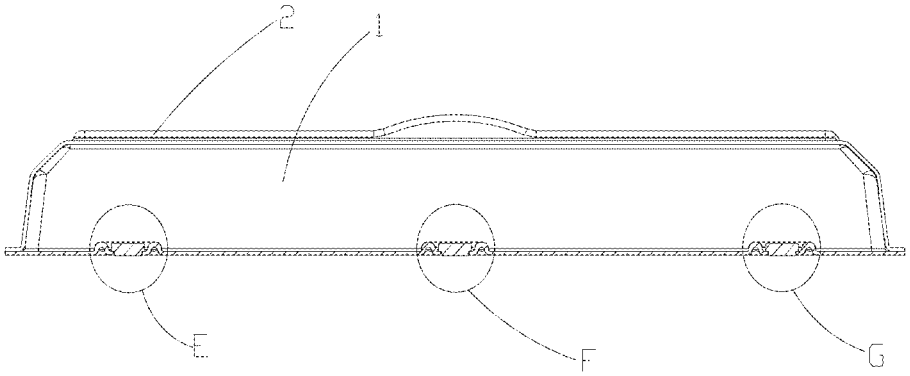
FIG. 21 is a cross-sectional view of Embodiment 2 taken along the X axis of the present disclosure.
Figure 22:
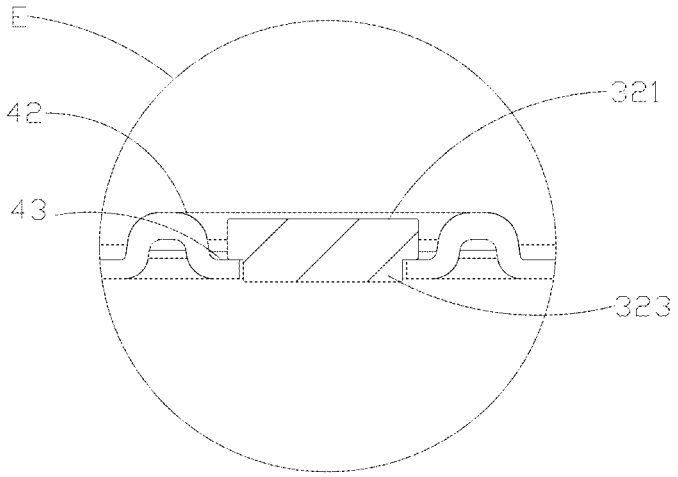
FIG. 22 is a structural schematic diagram at E in FIG. 21 of the present disclosure.
Figure 23:
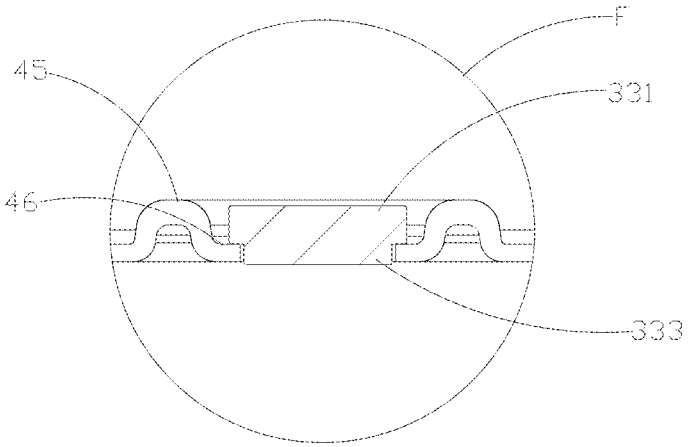
FIG. 23 is a structural schematic diagram at F in FIG. 21 of the present disclosure.
Figure 24:
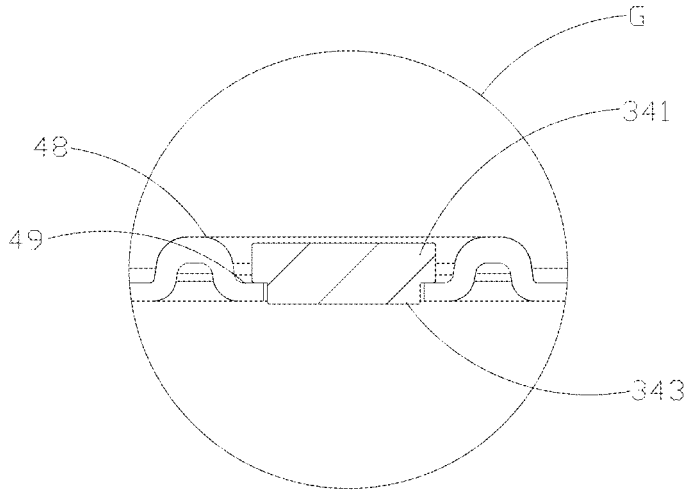
FIG. 24 is a structural schematic diagram at G in FIG. 21 of the present disclosure.

Referring to FIGS. 1 to 24, a ventilation opening extender includes a first extension structure 1, a second extension structure 2 and a magnetic structure 3. The first extension structure 1 is arranged at a ventilation opening 100. The second extension structure 2 covers the first extension structure 1 and is movable on the first extension structure 1. The magnetic structure 3 is configured for attracting the first extension structure 1 at the ventilation opening 100.

Through the above structure, the first extension structure 1 is arranged on the ventilation opening 100 to change an airflow direction of the ventilation opening. The second extension structure 2 covers the first extension structure 1 and is telescopically movable on the first extension structure 1, so as to extend the airflow direction. In this way, the airflow direction of the ventilation opening 100 can be conveniently changed according to actual needs of a user.

In the present embodiment, the first extension structure 1 includes a first side wall 11 and a second side wall 12. The first side wall 11 and the second side wall 12 are arranged opposite to each other. A first top plate 13 is provided between the first side wall 11 and the second side wall 12. A first end of the first top plate 13 is connected to the first side wall 11. A second end of the first top plate 13 is connected to the second side wall 12. Through the above structure, the first side wall 11, the second side wall 12 and the first top plate 13 block the airflow, so that the airflow flows in a set direction.

In the present embodiment, a plurality of first protrusions 14 extend out from an upper surface of the first top plate 13. The plurality of first protrusions 14 are sequentially arranged on the upper surface of the first top plate 13. The plurality of first protrusions 14 extend in a width direction of the upper surface of the first top plate 13. A plurality of first recesses 15 extend from a lower surface of the first top plate 13. The plurality of first recesses 15 are sequentially arranged on the lower surface of the first top plate 13. The plurality of first protrusions 14 and first recesses 15 in a one-to-one correspondence. A second protrusion 16 extends from an upper surface of each of the first protrusions 14. A second recess 17 extends from a lower surface of each of the first protrusions 14. The second protrusion 16 corresponds to the second recess 17 in position. Through the above structure, the second protrusion 16 is arranged on the first protrusion 14. The first recess 15 is in communication with the second recess 17. The plurality of first protrusions 14 are sequentially arranged along a length direction of the first top plate 13. The arc-shaped second protrusion 16 is arranged in a middle of the first protrusion 14.

In the present embodiment, the first side wall 11 includes a first side surface 111 and a second side surface 112. The first side surface 111 and the second side surface 112 are arranged at an included angle. The first side surface 111 is connected to the first top plate 13. A first end of the second side surface 112 is connected to the first side surface 111. A second end of the second side surface 112 is provided with the first rim 113 along a length direction of the first extension structure 1. The second side wall 12 includes a third side surface 121 and a fourth side surface 122. The third side surface 121 and the fourth side surface 122 are arranged at an included angle. The third side surface 121 is connected to the first top plate 13. A first end of the fourth side surface 122 is connected to the third side surface 121. A second end of the fourth side surface 122 is provided with a second rim 123 along the length direction of the first extension structure 1. Through the above structure, the first side surface 111 and the second side surface 112 are arranged at an included angle, and specifically, the included angle may be an acute angle or a right angle. The first rim 113 is attached to a surface of a first side of the ventilation opening 100. The third side 121 and the fourth side 122 are provided at an included angle, specifically, the included angle may be an acute angle or a right angle. The second rim 123 is attached to a surface of a second side of the ventilation opening 100.

In the present embodiment, the first extension structure 1 further includes a third side wall 18 and a first opening 19 arranged opposite to the third side wall 18. The third side wall 18 is arc-shaped. The third side wall 18 is provided with a first end 181 and a second end 182. The first end 181 of the third side wall 18 is connected to the first side wall 11. The second end 182 of the third side wall 18 is connected to the second side wall 12. The third side wall 18 is further provided with a third end 183 and a fourth end 184. The third end 183 of the third side wall 18 is connected to the first top plate 13. The fourth end 184 of the third side wall 18 is provided with a third rim edge 4. Two ends of the third rim 4 are respectively connected to the first rim 113 and the second rim 123. The third rim 4, the first rim 113 and the second rim 123 are coplanar. Through the above structure, the third side wall 18, the first side wall 11, the second side wall 12, and the first top plate 13 form a cavity. The airflow flows out from the ventilation opening 100 into the cavity, and the airflow flows in the cavity and flows from the first opening 19 to the second extension structure 2. The third rim 4 is attracted by the magnetic structure 3 to be fixed on one side of the ventilation opening 100.

In the present embodiment, the second extension structure 2 includes a fourth side wall 21 and a fifth side wall 22. The fourth side wall 21 is arranged opposite to the fifth side wall 22. A second top plate 23 is provided between the fourth side wall 21 and the fifth side wall 22. A first end of the second top plate 23 is connected to the fourth side wall 21. A second end of the second top plate 23 is connected to the fifth side wall 22. Through the above structure, the fourth side wall 21, the fifth side wall 22 and the second top plate 23 form a through cavity. The through cavity is in communication with a cavity of the first extension structure 1, and the airflow flows into the through cavity from the cavity of the first extension structure 1 and flows out.

In the present embodiment, a plurality of third protrusions 24 extend out from an upper surface of the second top plate 23. The plurality of third protrusions 24 are sequentially arranged on the upper surface of the second top plate 23. The plurality of third protrusions 24 extend in a width direction of the upper surface of the second top plate 23. A plurality of third recesses 25 extends from a lower surface of the second top plate 23. The plurality of third recesses 25 are sequentially arranged on the lower surface of the second top plate 23 and are in one-to-one correspondence with the plurality of third protrusions 24. A fourth protrusion 26 extends out from an upper surface of each of the third protrusion 24. A fourth recess 27 extends from a lower surface of each of the third protrusion 24. The fourth protrusion 26 corresponds to the fourth recess 27 in position. Through the above structure, the fourth protrusion 26 is arranged on the third protrusion 24, and the third recess 25 is in communication with the fourth recess 27. The plurality of third protrusions 24 are sequentially arranged along a length direction of the second top plate 23. The arc-shaped fourth protrusion 26 is arranged in a middle of the third protrusion 24.

In the present embodiment, the fourth side wall 21 includes a fifth side surface 211 and a sixth side surface 212. The fifth side surface 211 and the sixth side surface 212 are arranged at an included angle. The fifth side surface 211 is connected to the second top plate 23. A first end of the sixth side surface 212 is connected to the fifth side surface 211, and a second end of the sixth side surface 212 is provided with a fourth rim 213. The fifth side wall 22 includes a seventh side surface 221 and an eighth side surface 222. The seventh side surface 221 and the eighth side surface 222 are arranged at an included angle. The seventh side surface 221 is connected to the second top plate 23. A first end of the eighth side surface 222 is connected to the seventh side surface 221. A second end of the eighth side surface 222 is provided with a fifth rim 223 along a length direction of the second extension structure 2. Through the above structure, the fifth side surface 211 and the sixth side surface 212 are arranged at an included angle, specifically, the included angle may be an acute angle or a right angle. A first end of the fourth rim 213 is arranged on the first rim 113, and a second end of the fourth rim 213 is arranged along a length direction of the first rim 113. The seventh side surface 221 and the eighth side surface 222 are arranged at an included angle, specifically, the included angle can be an acute angle or a right angle. A first end of the fifth rim 223 is arranged on the second rim 123, and a second end of the fifth rim 223 is arranged along a length direction of the second rim 123.

In the present embodiment, the magnetic structure 3 includes a plurality of magnetic members 31. The plurality of magnetic members 31 are sequentially arranged on the third rim 4 along a width direction of the third rim 4. The plurality of magnetic members 31 magnetically attract the first extension structure 1 to a periphery of the ventilation opening 100 and enable the first extension structure 1 to cover the ventilation opening 100.

In Embodiment 1, the plurality of magnetic members 31 include a first magnetic member 32. The first magnetic member 32 includes a first end portion 321 and a second end portion 322. The first end portion 321 is connected to the second end portion 322 via a first connecting rod 323. The third rim 4 defines a first through hole 41. The first end portion 321 and the second end portion 322 are respectively arranged on two sides of the first through hole 41. The first connecting rod 323 is arranged in the first through hole 41 and is respectively connected to the first end portion 321 and the second end portion 322. A radius of the first end portion 321 and a radius of the second end portion 322 is greater than a radius of the first connecting rod 323 and a radius of the first through hole 41. The third rim 4 is provided with a first annular protrusion 42 around the first through hole 41. A first step surface 43 is provided between the first annular protrusion 42 and the first through hole 41. The first end portion 321 is arranged on the first step surface 43. Through the above structure, the first end portion 321 is arranged on the first step surface 43. The first step surface 43 is arranged around the first through hole 41. The radius of the first end portion 321 is greater than the radius of the first through hole 41, so that the first end portion 321 is limited within the first step surface 43. The first end portion 321 and the second end portion 322 are arranged on two side of the third rim 4 to clamp the third rim 4. The first magnetic member 32 attracts the periphery of the ventilation opening 100 and fixes the first extension structure 1 at the ventilation opening 100.

The plurality of magnetic members 31 include a second magnetic member 33. The second magnetic member 33 includes a third end portion 331 and a fourth end portion 332. The third end portion 331 is connected to the fourth end portion 332 through the second connecting rod 333. The third rim 4 defines a second through hole 44. The third end portion 331 and the fourth end portion 332 are respectively arranged on two sides of the second through hole 44. The second connecting rod 333 is arranged in the second through hole 44 and is respectively connected to the third end portion 331 and the fourth end portion 332. A radius of the third end portion 331 and the fourth end portion 332 is greater than a radius of the second connecting rod 333 and a radius of the second through hole 44. The third rim 4 is provided with a second annular protrusion 45 around the second through hole 44. A second step surface 46 is formed between the second annular protrusion 45 and the second through hole 44. The fourth end portion 331 is arranged on the second step surface 46. Through the above structure, the third end portion 331 is arranged on the second step surface 46, and the second step surface 46 is arranged around the second through hole 44. The radius of the third end portion 331 is greater than the radius of the second through hole 44, so that the third end portion 331 is limited within the second step surface 46. The third end portion 331 and the fourth end portion 332 are arranged on the two sides of the third rim 4 to clamp the third rim 4. The second magnetic member 33 attracts the periphery of the ventilation opening 100 and fixes the first extension structure 1 to the ventilation opening 100.

The plurality of magnetic members 31 include a third magnetic member 34. The third magnetic member 31 includes a fifth end portion 341 and a sixth end portion 342. The fifth end portion 341 is connected to the sixth end portion 342 through a third connecting rod 343. The third rim 4 defines a third through hole 47. The fifth end portion 341 and the sixth end portion 342 are respectively arranged on two sides of the third through hole 47. The third connecting rod 343 is arranged in the third through hole 47 and is respectively connected to the fifth end portion 341 and the sixth end portion 342. A radius of the fifth end portion 341 and the sixth end portion 342 is greater than a radius of the third connecting rod 343 and a radius of the third through hole 47. A third annular protrusion 48 is arranged on the third rim 4 around the third through hole 47. A third step surface 49 is arranged between the third annular protrusion 48 and the third through hole 47. The fifth end 341 is arranged on the third step surface 49. Through the above structure, the fifth end portion 341 is arranged on the third step surface 49. The third step face 49 is arranged around the third through hole 47. The radius of the fifth end portion 341 is greater than the radius of the third through hole 47, so that the fifth end portion 341 is limited within the third step surface 49. The fifth end portion 341 and the sixth end portion 342 are arranged on the two sides of the third rim 4 to clamp the third rim 4. The third magnetic member 34 attracts the periphery of the ventilation opening 100 and fixes the first extension structure 1 to the ventilation opening 100.

In embodiment 2, the first magnetic member 32 can also be provided with only the first end portion 321 and the first connecting rod 323. The first end portion 321 is arranged on the first step surface 43, and the first connecting rod 323 is arranged in the first through hole 41. The radius of the first end portion 321 is greater than the radius of the first through hole 41, so that the first end portion 321 can only be limited within the first step surface 43 and cannot be placed in the first through hole 41. The second magnetic member 33 can also be provided with only the third end portion 331 and the second connecting rod 333. The third end portion 331 is arranged on the second step surface 46, and the second connecting rod 333 is arranged in the second through hole 44. The radius of the third end portion 331 is greater than the radius of the second through hole 44, so that the third end portion 331 can only be limited within the second step surface 46 and cannot be placed in the second through hole 44. The third magnetic member 34 can also be provided with only the fifth end portion 341 and the third connecting rod 343. The fifth end portion 341 is arranged on the third step surface 49, and the third connecting rod 343 is arranged in the third through hole 47. The radius of the fifth end portion 341 is greater than the radius of the third through hole 47, so that the fifth end portion 341 can only be limited within the third step surface 49 and cannot be placed in the third through hole 47.

In the present embodiment, the second extension structure 2 is arranged on the first extension structure 1. The first protrusion 14 and the third protrusion 24 are interlocked, and the second protrusion 16 and the fourth protrusion 26 are interlocked, so that the second extension structure 2 is fixed on the first extension structure 1. The ventilation opening extender may be made from, but is not limited to, plastic, any other type of polymer, paper material, metal-based material, or other rigid or semi-rigid material capable of maintaining an opening to alter the direction of airflow discharged from the ventilation opening 100.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A ventilation opening extender, comprising:

a first extension structure, the first extension structure being arranged at a ventilation opening;

a second extension structure covering the first extension structure and being movable on the first extension structure;

a magnetic structure, wherein the magnetic structure is configured for attracting the first extension structure at the ventilation opening;

wherein the first extension structure comprises a first side wall and a second side wall, and the first side wall is arranged opposite to the second side wall; a first top plate is provided between the first side wall and the second side wall; a first end of the first top plate is connected to the first side wall, and a second end of the first top plate is connected to the second side wall;

wherein the first extension structure further comprises a third side wall and a first opening arranged opposite to the third side wall, and the third side wall is arc-shaped; the third side wall is provided with a first end and a second end, a first end of the third side wall is connected to the first side wall, and a second end of the third side wall is connected to the second side wall;

wherein the third side wall is further provided with a third end and a fourth end, the third end of the third side wall is connected to the first top plate, and the fourth end of the third side wall is provided with a third rim; two ends of the third rim are respectively connected to the first rim and the second rim, and the third rim, the first rim and the second rim are coplanar;

wherein the magnetic structure comprises a plurality of magnetic members, and the plurality of magnetic members are all arranged on the third rim; and the plurality of magnetic members are sequentially arranged on the third rim along a width direction of the third rim;

wherein the plurality of magnetic members comprise a first magnetic member, the first magnetic member comprises a first end portion and a second end portion, and the first end portion is connected to the second end portion through a first connecting rod; the third rim defines a first through hole, and the first end portion and the second end portion are respectively arranged on two sides of the first through hole; the first connecting rod is arranged in the first through hole and is respectively connected to the first end portion and the second end portion, and a radius of the first end portion and a radius of the second end portion are greater than a radius of the first connecting rod and a radius of the first through hole; the third rim is provided with a first annular protrusion around a periphery of the first through hole, a first step surface is provided between the first annular protrusion and the first through hole, and the first end portion is arranged on the first step surface.

2. The ventilation opening extender according to claim 1, wherein a plurality of first protrusions extend out from an upper surface of the first top plate, and the plurality of first protrusions are sequentially arranged on the upper surface of the first top plate; and the plurality of first protrusions extend in a width direction of the upper surface of the first top plate.

3. The ventilation opening extender according to claim 2, wherein a plurality of first recesses extend from a lower surface of the first top plate, and the plurality of first recesses are sequentially arranged on the lower surface of the first top plate; the plurality of first protrusions and first recesses are in a one-to-one correspondence.

4. The ventilation opening extender according to claim 2, wherein a second protrusion extends out from an upper surface of each of the first protrusions, and a second recess extends from a lower surface of each of the first protrusions; the second protrusion is positioned opposite to the second recess.

5. The ventilation opening extender according to claim 1, wherein the first side wall comprises a first side surface and a second side surface, and the first side surface and the second side surface are arranged at an included angle; the first side surface is connected to the first top plate, a first end of the second side surface is connected to the first side surface, and a second end of the second side surface is provided with a first rim along a length direction of the first extension structure.

6. The ventilation opening extender according to claim 5, wherein the second side wall comprises a third side surface and a fourth side surface, and the third side surface and the fourth side surface are arranged at an included angle; the third side surface is connected to the first top plate, a first end of the fourth side surface is connected to the third side surface, and a second end of the fourth side surface is provided with a second rim along the length direction of the first extension structure.

7. The ventilation opening extender according to claim 4, wherein the second extension structure comprises a fourth side wall and a fifth side wall, and the fourth side wall is arranged opposite to the fifth side wall; a second top plate is provided between the fourth side wall and the fifth side wall, a first end of the second top plate is connected to the fourth side wall, and a second end of the second top plate is connected to the fifth side wall.

8. The ventilation opening extender according to claim 7, wherein a plurality of third protrusions extend out from an upper surface of the second top plate, and the plurality of third protrusions are sequentially arranged on the upper surface of the second top plate; and the plurality of third protrusions extend in a width direction of the upper surface of the second top plate.

9. The ventilation opening extender according to claim 8, wherein a plurality of third recesses extend from a lower surface of the second top plate, and the plurality of third recesses are sequentially arranged on the lower surface of the second top plate and are in a one-to-one correspondence with the plurality of third protrusions.

10. The ventilation opening extender according to claim 8, wherein a fourth protrusion extends out from an upper surface of each of the third protrusions, a fourth recess extends from a lower surface of each of the third protrusions, and the fourth protrusion corresponds to the fourth recess in position.

11. The ventilation opening extender according to claim 7, wherein the fourth side wall comprises a fifth side surface and a sixth side surface, and the fifth side surface and the sixth side surface are arranged at an included angle; the fifth side surface is connected to the second top plate, a first end of the sixth side surface is connected to the fifth side surface, and a second end of the sixth side surface is provided with a fourth rim.

12. The ventilation opening extender according to claim 7, wherein the fifth side wall comprises a seventh side surface and an eighth side surface, and the seventh side surface and the eighth side surface are arranged at an included angle; the seventh side surface is connected to the second top plate, a first end of the eighth side surface is connected to the seventh side surface, and a second end of the eighth side surface is provided with a fifth rim along a length direction of the second extension structure.

13. The ventilation opening extender according to claim 1, wherein the plurality of magnetic members comprise a second magnetic member, and the second magnetic member comprises a third end portion and a fourth end portion; the third end portion is connected to the fourth end portion via a second connecting rod, the third rim defines a second through hole, and the third end portion and the fourth end portion are respectively arranged on two sides of the second through hole; the second connecting rod is arranged in the second through hole and is respectively connected to the third end portion and the fourth end portion, and a radius of the third end portion and the fourth end portion are greater than a radius of the second connecting rod and a radius of the second through hole; the third rim is provided with a second annular protrusion around a periphery of the second through hole, a second step surface is provided between the second annular protrusion and the second through hole, and the fourth end portion is arranged on the second step surface.

14. The ventilation opening extender according to claim 13, wherein the plurality of magnetic members comprise a third magnetic member, the third magnetic member comprises a fifth end portion and a sixth end portion, and the fifth end portion is connected to the sixth end portion through a third connecting rod; the third rim defines a third through hole, and the fifth end portion and the sixth end portion are respectively arranged on two sides of the third through hole; the third connecting rod is arranged in the third through hole and is respectively connected to the fifth end portion and the sixth end portion, and a radius of the fifth end portion and the sixth end portion are greater than a radius of the third connecting rod and a radius of the third through hole; the third rim is provided with a third annular protrusion around the third through hole, a third step surface is provided between the third annular protrusion and the third through hole, and the fifth end portion is arranged on the third step surface.

15. The ventilation opening extender according to claim 10, wherein the second extension structure is arranged on the first extension structure, the first protrusion is interlocked with the third protrusion, and the second protrusion is interlocked with the fourth protrusion.

* * * * *